US008017020B2

(12) United States Patent
Hoskin et al.

(10) Patent No.: US 8,017,020 B2
(45) Date of Patent: Sep. 13, 2011

(54) METHOD FOR DETERMINING THE FILTERABILITY OF JET FUEL CONTAINING ADDITIVE(S) AND CONDITIONS FOR THE DELIVERY OF ACCEPTABLE WATER CONTENT FUEL

(75) Inventors: Dennis H. Hoskin, Westampton, NJ (US); Michele S. Touvelle, Media, PA (US); Krystal B. Wrigley, Turnersville, NJ (US); Paul P. Wells, Mullica Hill, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 191 days.

(21) Appl. No.: 12/378,465

(22) Filed: Feb. 13, 2009

(65) Prior Publication Data

US 2009/0289013 A1 Nov. 26, 2009

Related U.S. Application Data

(60) Provisional application No. 61/066,970, filed on Feb. 25, 2008.

(51) Int. Cl.
*B01D 15/04* (2006.01)
*B01D 39/00* (2006.01)

(52) U.S. Cl. ..... 210/739; 210/662; 210/689; 210/749; 210/808; 210/500.21

(58) Field of Classification Search ..... None
See application file for complete search history.

(56) References Cited

U.S. PATENT DOCUMENTS

| | | | | |
|---|---|---|---|---|
| 2,805,625 | A | 9/1957 | Crow | |
| 3,062,744 | A | 11/1962 | Thompson | |
| 3,230,058 | A | 1/1966 | Walters | |
| 3,785,970 | A | 1/1974 | Hodgkins | |
| 4,592,849 | A | 6/1986 | McMillen | |
| 4,787,949 | A | 11/1988 | Cole | |
| 5,156,767 | A | 10/1992 | Fitzgerald et al. | |
| 5,468,262 | A | 11/1995 | Acker et al. | |
| 5,705,087 | A * | 1/1998 | Mushrush et al. | 252/70 |
| 2004/0020106 | A1 | 2/2004 | Tack | |

FOREIGN PATENT DOCUMENTS

| | | |
|---|---|---|
| EP | 1533359 | 5/2005 |
| GB | 802588 | 10/1958 |
| GB | 1046317 A | 10/1966 |

(Continued)

OTHER PUBLICATIONS

Sareen et al., Coalescence in Fibrous Beds, Nov. 1966, A.I.Ch.E. Journal, vol. 12, No. 6, 1045-1050.*

Moorthy et al., Touch Oil and Gas, Nov. 2007, Effect of Surface Energy of Fibres on Coalescence Fuel Filtration, Accessed online on Jan. 4, 2011, http://www.touchoilandgas.com/effect-surface-energy-fibres-a7706-1.html.*

(Continued)

*Primary Examiner* — Krishnan S Menon
*Assistant Examiner* — Allison M Gionta

(57) ABSTRACT

It has been discovered that jet fuel containing enhanced thermal stability additives and water can be delivered with a final water content of 15 ppm or less via existing jet fuel distribution system by controlling the fuel flow rate through the fuel delivery system comprising one or more filter coalescers and separator systems, said controlled fuel flow rate being determined by passing a sample of actual fuel through a sample of the fuel filter at various fuel flow rates to identify the flowrate at which the fuel effluent contains 15 ppm or less.

14 Claims, 2 Drawing Sheets

FOREIGN PATENT DOCUMENTS

| | | | |
|---|---|---|---|
| GB | 2022433 | A | 12/1979 |
| WO | WO 98/20990 | | 5/1998 |
| WO | WO99/25793 | | 5/1999 |
| WO | WO03/059485 | A | 7/2003 |
| WO | WO2004/015031 | A | 2/2004 |
| WO | WO2008/149206 | A | 12/2008 |

OTHER PUBLICATIONS

Velcon, Coalescer Cartridges for Aviation and Industrial Use, PDF.*

Rawson, AMRL Evaulation of the JP-8+100 Jet Fuel Stability Additive, 2004, Airframes and Engines Division Aeronautical and Maritime Research Laboratory, Department of Defense.*

* cited by examiner

METHOD FOR DETERMINING THE FILTERABILITY OF JET FUEL CONTAINING ADDITIVE(S) AND CONDITIONS FOR THE DELIVERY OF ACCEPTABLE WATER CONTENT FUEL

Non Provisional Application based on U.S. Ser. No. 61/066,970 filed Feb. 25, 2008.

FIELD OF THE INVENTION

The present invention is directed to a method for delivering jet fuel that contains an effective amount of additives to the end user with an acceptable water content.

BACKGROUND OF THE INVENTION

Jet fuel is a hydrocarbon boiling in the 350 to 572° F. range. In addition to constituting the power sources for gas turbine engines used in both ground-based and military and civilian aviation applications increasing demands are being placed on the fuel, as aircraft evolve, to function as a coolant/heat sink for engine and other equipment; i.e., aircraft subsystems. Consequently, jet fuel is exposed to temperature environments substantially hotter than traditionally encountered when used simply as a fuel.

By the exposure of the fuel to such higher temperature environments, such as the system for cooling aircraft engine subsystems or engine lubricant oils, the jet fuel is subjected to heat induced stress which causes fuel thermal oxidation breakdown products to form; e.g., gums, lacquers, coke, ash, which can and do form deposits on engine internal parts leading to engine inefficiency and, in extreme cases, engine failures. This situation leads to reduced maintenance intervals and significantly increased maintenance costs.

To combat such thermal oxidation breakdown, fuel formulators have begun adding enhanced thermal stability additive to the fuel, which slow the reaction of the fuel hydrocarbon components with the dissolved oxygen in the fuel and disperse those polymeric oxidation products which do form so that they pass through the engine and burn during combustion rather than accumulating and depositing on engine component surfaces such as fuel controllers, burner nozzles, the afterburner spray assemblies, the manifolds, the thrust vectoring actuators, the pumps, the valves, the filters and the heat exchanger surfaces. Engine smoke emissions and noise also increase as a result of the thermal-oxidative deposits.

Numerous additives and additive systems have been put forward for the enhancement of the thermal stability of hydrocarbon materials.

WO 98/20990 discloses a method for cleaning and inhibiting the formation of fouling deposits on jet engine components. The method involves the addition of a derivative of (thio)phosphenic acid to the jet fuel. Unfortunately, the (thio) phosphenic acid disarms the filters in the ground-based water-separators. Therefore, this additive must be added to the jet fuel at the skin of the aircraft; i.e., this additive must not be added to the jet fuel prior to fuelling the aircraft.

WO 99/25793 discloses the use of "salixarenes" to prevent deposits in jet fuel at a temperature of 180° F.

U.S. Pat. No. 5,468,262 discloses the use of phenol-aldehyde-polyamine Mannich condensate with a succinic acid anhydride bearing a polyolefin to improve the thermal stability of jet fuel at 260° F.

U.S. Pat. No. 3,062,744 describes the use of a hydrochloric acid salt of a polymer formed from an amine-free monomer and an amine-containing monomer for reducing deposits in refinery heat exchangers. It is stated that polymer itself is not effective, only the HCl salt.

U.S. Pat. No. 2,805,625 relates to the stabilization of petroleum-based oils in storage. Polymers of amino-containing monomers with oleophilic monomers were found to be ineffective for demulsifying water-oil mixtures. Water separation was achieved by adding a further co-additive of a fatty acid amide.

GB 802,588 describes a fuel composition comprising a copolymer of a compound with at least one ethylenic linkage and at least one α-β-unsaturated monocarboxylic acid. The acid monomer may be derivatized with polar groups provided that at least 20% of the carboxyl groups remain unreacted.

Because jet fuel is also exposed to lower temperatures during use that cause free water present in the jet fuel to freeze, which can cause plugging of filters and other small orifices, and occasionally engine flameout, such free water must be removed from the fuel prior to delivery to the end user, be it commercial or military. As jet fuel is transported through the distribution system (i.e., pipelines, ships, barges, storage tanks, etc.), it can pick up free water from the drop out of dissolved water when the fuel cools, condensation of atmospheric moisture and ground water/rain water incursion. This water is normally removed by passing the jet fuel through filter/coalescer and separator systems, such systems being comprised of a filter/coalescer cartridge and a separator cartridge specified by API/IP 1581 $3^{rd}$ edition or $5^{th}$ edition (Category C) at several points in the fuel distribution system, usually at least into and out of airport storage facilities. Military and certain FSII (fuel system icing inhibitor also known as diethylene glycol monomethyl ether (DiEGME)) users may use API/IP 1581 $5^{th}$ edition Category M or M100 filter systems but the use of these systems is generally limited to the end of the distribution system. Into-plane jet fuel water content standards are either 15 ppm (ATA-103) or 30 ppm (IATA) as cited in the airline operator's handling standards, where ATA-103 is commonly cited in the U.S. and IATA ex U.S. (outside the former Soviet Union and China). These limits are always met when FSII is absent and properly operating API/IP 1581 filter systems are used to filter Jet A or Jet A-1 for commercial aviation. (The Jet A/A-1 international specifications, D1655 and DefStan 91-91, limit the formulations and concentrations of additives to protect the water separability performance of API/IP 1581 filter systems.) The maximum effluent water content permitted by API/IP 1581 in laboratory compliance testing is 15 ppm. It has been found that fuels additized with certain various additives, particularly with thermal stability additives, degrade the water removal performance of API/IP 1581 filtration systems, so that the filtered fuel may not be sufficiently is dry to meet into-plane water content standards. Such additized fuels are considered to be not "filter friendly" and cannot be distributed via the existing API/IP 1581 compliant distribution system without significant modifications. Currently the use of such additives is limited to military fuel (e.g. JP-8) and non-commercial use of Jet A/A1.

EP 1,533,359 teaches a thermal-oxidation stability additive comprising one or more copolymer, terpolymer or polymer of an ester of acrylic acid or methacrylic acid or a derivative thereof wherein the copolymer, terpolymer or polymer of an ester of acrylic acid or methacrylic acid or derivative thereof is copolymerized with a nitrogen-containing or amide-containing monomer, or the copolymer, terpolymer or polymer of an ester of acrylic acid or methacrylic acid or derivative thereof includes nitrogen-containing, amine-containing or amide-containing branches. The additive package containing this material also preferably contains at least one aminic or phenolic acid, or both, at least one ashless dispersant, preferably a hydrocarbyl or polyalkenyl succinimide or a derivative thereof. Other optional additional components can include metal deactivators, lubricating additives, corrosion inhibitors, anti-icing additives, brocides, anti-rust agents, anti-foaming agents, demulsifiers, detergents, cetane improvers, stabilizers, static dissipaters and the like and mixture thereof. It is reported that the additives system does not adversely affect the API/IP 1581 water coalescing filters which form part of the ground-based fuel delivery system, on the basis that the additive gives passing MSEP (ASTM D3948) results. While MSEP is widely used in the aviation industry to control the content of natural surfactants in jet fuel that are known to degrade the water separation performance of coalescing filters, the materials and fuel flow rates of the MSEP test are sufficiently different from the field implementation of API/IP 1581 filter/coalescer and separator systems that MSEP cannot predict the performance of field systems.

Part of the deficiency of the MSEP evaluative process is that there are at least three mechanisms by which surfactants can inactivate (disarm) the water removal performance of API/IP 1581 filter/coalescer and separator systems:

1. Surfactants can reduce the interfacial tension between jet fuel and water stabilizing the persistence of very small water droplets. The small water droplets can move with the flow of jet fuel through the coalescer more readily than larger droplets and avoid being intercepted by hydrophilic fibers, which normally accumulate and coalesce small water droplets into larger, readily separable water droplets. In addition, if the water droplets are intercepted and coalesced by the fibers, the low fuel/water interfacial tension tends to cause the droplets to be redispersed as they pass through higher shear regions of the filter/coalescer cartridge.
2. Surfactants can adsorb on the hydrophilic surface of the coalescer media rendering it hydrophobic. The modified surface does not attract water droplets and thus the water does not coalesce.
3. Surfactants can adsorb on the hydrophobic parts of the coalescer media rendering it hydrophilic. The proper function of the coalescer media relies on nodules or nodes of hydrophobic material on the hydrophilic fibers to cause coalesced droplets to separate from the fiberglass surface when they reach a certain size. When these nodes become hydrophilic, coalescence is not limited, thus resulting the formation of sheets of water between fiberglass fibers. When these sheets become large enough, the flow of jet fuel through the coalescer bed disrupts them forming many very small water droplets that are reentrained in the jet fuel.

The coalescence media in Alumicel® MSEP cartridges is not the same and the flow/shear rate is much higher versus commercial filter/coalescer cartridge elements so the MSEP number does not necessarily predict water removal performance in the field. For example a certain diesel lubricity improver reduced the MSEP of a jet fuel from 98 unadditized to 85 with 100 ppm of the additive (70 MSEP with 200 ppm of additive). Fuels with an MSEP rating of 85 normally are considered to be filter friendly; that is, to not disarm coalescers. In a week-long laboratory experiment designed to test the field coalescers of API/IP 1581 systems using the same materials as the field API/IP 1581 systems and scaled from field flowrates to 100 ml/min, the coalescers failed with only 35 ppm of this additive in jet fuel despite having passed the MSEP test. In another example, it is commonly believed that MSEP over responds to certain weak surfactants such as the aviation approved conductivity improver Stadis 450, where API/IP 1581 filtration systems are not necessarily disarmed by fuels with low MSEP values. The DefStan 91-91 jet fuel specification recognizes this by specifying different limits for jet fuel MSEP at the point of manufacture depending upon the content of Stadis 450 (70 MSEP min. in the presence of Stadis 450 and 85 MSEP min. in its absence). This demonstrates the need for the method disclosed below to accurately assess the impact of fuels/additives on API/IP 1581 systems that comprise the basis of the jet fuel distribution system. Thus a need exists for determining the filterability of each jet fuel in API/IP 1581 systems.

An advantage of the present method is that it can determine whether jet fuel, regardless of the additive or additive package present in such fuel and regardless of the water content in such fuel, can be processed so as to be delivered with acceptable water content upon delivery; i.e., have a water content upon delivery to the final consumer of about 15 ppm or less, and to identify the specific processing conditions and limits.

The method disclosed herein can be used to map any effluent water level, but 15 ppm is preferred, to ensure that field systems operate to the same standards used in design and qualification of API/IP 1581 filtration systems.

The present invention can enable the wider application of thermal stability additives by reducing the risk of an incident caused by inadequate water separation performance of API/IP 1581 filter/coalescer and separator systems.

SUMMARY OF THE INVENTION

Figure 1:
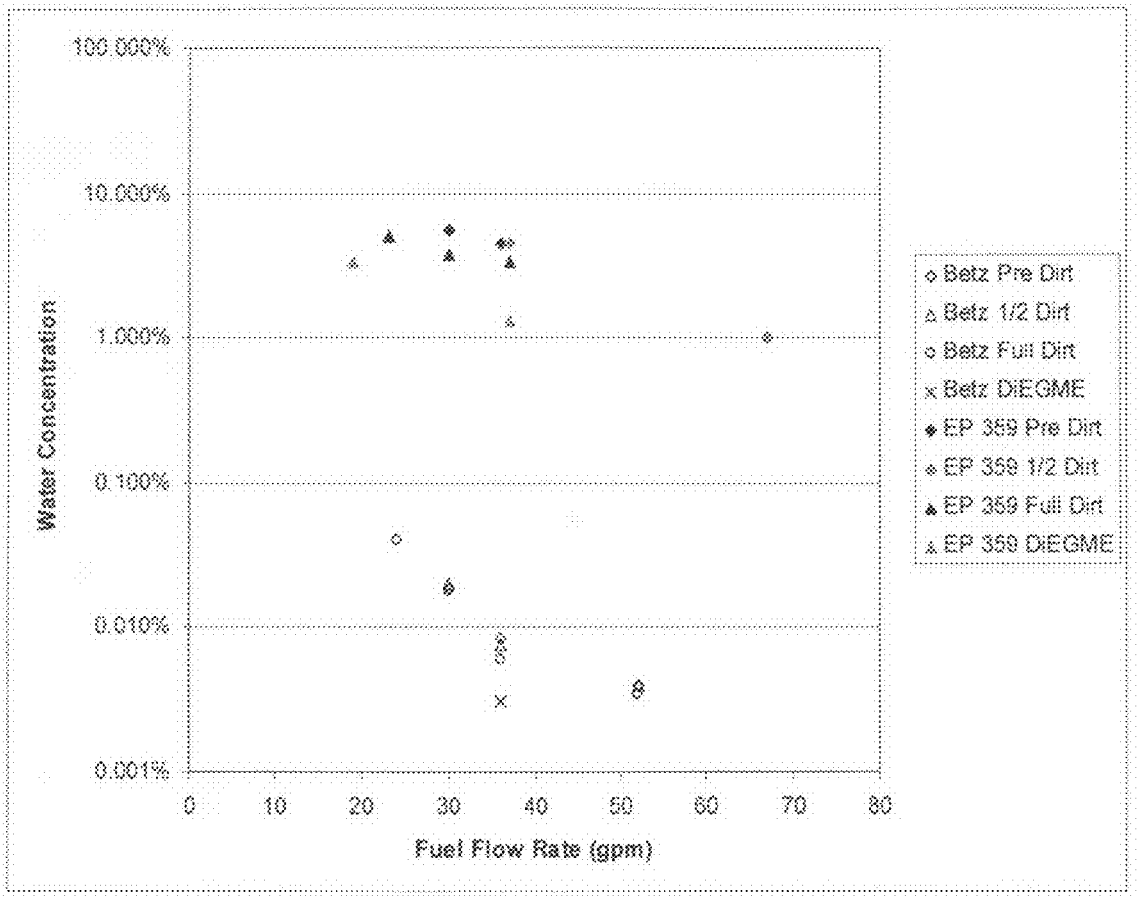
FIG. 1 presents a map of fuel feed water content vs. fuel flow rate for wet fuels containing different thermal stability additive systems and shows the regime for each such fuel within which the fuel can be successfully filtered to a 15 ppm final water content level.

The present invention relates to a method for determining the suitability of additized jet fuel for delivery with an acceptable water content comprising:

(1) securing a sample of the wet-additized jet fuel;

(2) passing the sample of the jet fuel through an operable filter/coalescer cartridge, meaning a filter/coalescer cartridge which is not deactivated or contaminated, preferably a new, unused, sample of the filter/coalescer cartridge and preferably through a system comprised of a combination of a sample of the filter/coalescer cartridge material and of the separator cartridge material of the type intended for use in the filter/coalescer and separator system to be employed to deliver dry fuel to the end user, at a number of feed fuel flow rates to produce a filtered fuel effluent;

(3) measuring the water content of the filtered fuel at the different feed fuel flow rates;

(4) identifying the feed fuel flow rate at which the filtered fuel has a water content meeting the acceptable target value, preferably about 15 ppm or less (U.S. (ATA-103) standard) or about 30 ppm or less (IATA (International) standard);

(5) employing the identified feed fuel flow rate at which the filtered fuel has a water content meeting the acceptable target value as the maximum feed fuel flow rate at which to operate the filter coalescer and separator system.

In an alternative embodiment, the invention comprises a method for determining the capacity of a filter/coalescer cartridge, and preferably of a filter/coalescer cartridge and separator cartridge system for the commercial removal of water from wet-additized jet fuel for the delivery of additized jet fuel with an acceptable water content, said method comprising:

(1) securing a sample of dry-unadditized jet fuel;

(2) additizing the jet fuel sample;

(3) securing at least an operable filter/coalescer cartridge, meaning a filter/coalescer cartridge which is not deactivated or contaminated, preferably a new, previously unused filter/coalescer cartridge, preferably securing a system comprising at least one new filter/coalescer cartridge and at least one either new or clean, used separator cartridge of the type(s) to be used in the practice of the commercial dewatered jet fuel delivery process;

(4) circulating dry-additized jet fuel through the filter/coalescer cartridge or through the system to condition the filter/coalescer cartridge;

(5) following the conditioning step, passing the dry additized jet fuel through the filter/coalescer cartridge or through the system at an initial controlled feed fuel flow rate, preferably about 2.6 gpm/inch of filter/coalescer cartridge, to produce a fuel effluent;

(6) measuring the water content of the fuel effluent;

(7) metering water into the additized fuel at different fuel rates to establish different additized fuel water content levels while flowing fuel through the filter/coalescer cartridge or through the system and monitoring the water content of the fuel effluent at the different additized fuel water content levels;

(8) reperforming steps 4 through 7 at a number of different higher and lower feed fuel flow rates, preferably rates of about 3.7 gpm/inch of filter/coalescer cartridge, 1.8 gpm/inch of filter/coalescer cartridge and 5 gpm/inch of filter/coalescer cartridge;

9) recording the water addition injection rate (i.e., additized fuel water content levels) and fuel effluent water content at the different fuel flow rates;

(10) determining, for example by direct measurement or interpolation the additized, fuel water content at each fuel flow rate that gives an effluent fuel water content meeting the acceptable water content level, preferably at most 15 ppm water;

(11) plotting the wet-additized feed fuel flow rate vs. the feed fuel water content values that yield an effluent fuel having the acceptable water content level, preferably 15 ppm water maximum;

(12) using this plot to determine the operational limits of the aviation filter/coalescer, preferably the limits of the aviation filter/coalescer and separator system to dewater wet-additized jet fuel.

In another embodiment, the present invention is directed to a method for evaluating, identifying and certifying additives for addition at any point in a jet fuel distribution system for the delivery of additized jet fuel with an acceptable water content, through a commercial dewatered jet fuel delivery process, such method comprising:

(1) securing a sample of dry-unadditized jet fuel;

(2) additizing the jet fuel sample with one or more additives being evaluated for certification;

(3) securing an operable filter/coalescer cartridge, meaning a filter/coalescer cartridge which is not deactivated or contaminated, preferably a new, previously unused filter/coalescer cartridge, preferably securing a system comprised of a new filter/coalescer cartridge and either a new or clean, used separator cartridge of the types to be used in the practice of the commercial dewatered jet fuel delivery process;

(4) circulating dry-additized jet fuel through the filter/coalescer cartridge or filter/coalescer and separator system to condition the filter/coalescer cartridge;

(5) passing the dry-additized jet fuel through the conditioned filter/coalescer cartridge or filter/coalescer and separator system at an initial controlled fuel flow rate, preferably about 2.6 gpm/inch of filter/coalescer cartridge, to produce a fuel effluent;

(6) measuring the water content of the fuel effluent;

(7) metering water into the additized fuel at different rates to establish different water content levels in the additized fuel while flowing the fuel through the filter/coalescer cartridge or filter/coalescer and separator system and monitoring the water content of the fuel effluent at the different additized fuel water content levels;

(8) repeating steps 4 through 7 at a number of different higher and lower fuel flow rates, preferably rates of about 3.7 gpm/inch of filter/coalescer cartridge, 1.8 gpm/inch of filter/coalescer cartridge and 5 gpm/inch of filter/coalescer cartridge;

(9) recording the additized fuel water content levels and fuel effluent water content levels at each of the different fuel flow rates;

(10) determining whether the additized fuel at any water content level at any of the flow rates gives an effluent fuel water content meeting the acceptable water content level or the water content level selected for mapping;

(11) plotting the wet-additized fuel flow rate versus the additized fuel water content level values for those additized fuels that yield an effluent fuel meeting the acceptable water content level or the water content level for mapping;

(12) determining from the plot for the additized fuel which produced an effluent meeting the acceptable water content level the additized fuel water content levels and fuel flow rate operational levels of the filter/coalescer cartridge or filter/coalescer and separator system which produce dewatered additized jet fuel;

(13) identifying for addition at any point in the jet fuel delivery system the additive or additives the presence of which in the jet fuel did not prevent the filter/coalescer or filter/coalescer and separator system from dewatering the wet-additized fuel to an acceptable water content level at an acceptable flow rate. The identification by the above procedure of an additive which is filter friendly permits the additive to be added to the fuel not just at the point of delivery of the fuel into the aircraft but at any point in the fuel storage/delivery system. Thus, the additive may be added to the fuel at the refinery or at the jet fuel inventory storage tank at the airport. Further, the identification of such filter friendly additive(s) further simplifies additized fuel handling procedures. Thus, fuels additized with such identified filter friendly additive(s) need not be segregated from the fuel inventory; that is, fuels delivered to aircraft tanks need not be handled separately if an aircraft needs to be defueled. Such fuels containing identified filter friendly additive(s) can be removed from aircraft fuel tanks (that is, aircraft can be defueled) and the fuel returned to the jet fuel inventory without any dilution or other special handling or disposal steps.

In another embodiment, the present invention is directed to a method for delivery of additized jet fuel with an acceptable water content level through a commercial dewatering system employing a system comprising filter/coalescer cartridge and separator cartridges, such method comprising:

(1) securing a sample of dry-unadditized jet fuel;

(2) additizing the jet fuel sample;

(3) securing an operable filter/coalescer cartridge, meaning a filter/coalescer cartridge which is not deactivated or contaminated, preferably a new, previously unused filter/coalescer cartridge, preferably a new filter/coalescer cartridge and either a new or clean, used separator cartridge of the type to be used in the filter/coalescer and separator system in the practice of the commercial dewatering process;

(4) circulating dry-additized jet fuel through the filter/coalescer cartridge or system comprised of a filter/coalescer cartridge and separator cartridge to condition the filter/coalescer cartridge;

(5) passing the dry-additized jet fuel through the conditioned filter/coalescer cartridge or system comprised of filter/coalescer cartridge and separator cartridge at an initial controlled fuel flow rate to produce a fuel effluent;

(6) measuring the water content of the fuel effluent;

(7) metering water into the additized fuel at different rates to establish different water content levels in the additized fuel, while flowing fuel through the cartridges and measuring the water content of the fuel effluent at the different additized fuel water content levels;

(8) repeating steps 4 through 7 at a number of different higher and lower fuel flow rates;

(9) recording the additized fuel water content levels and fuel effluent water content levels at the different fuel flow rates;

(10) determining the additized fuel water content at each fuel flow rate that gives an effluent fuel water content meeting the acceptable water content level;

(11) plotting the wet-additized fuel flow rate versus the additized fuel water content level values that yield at effluent having the acceptable water content level;

(12) determining from the plot the additized fuel water content level and fuel flow rate operational levels of the filter/coalescer and separator system to dewater wet-additized jet fuel;

(13) delivering additized jet fuel with an acceptable water content by operating the commercial jet fuel dewatering system at conditions of additized fuel water content levels and fuel flow rates within the operational limits established in the prior step.

In practicing any of the embodiments of this invention one or more filter/coalescer cartridges can be employed either in series or in parallel. Similarly, one or more filter/coalescer cartridge and separator cartridge systems can be used, also either in series or in parallel.

The water content of the effluent can be determined by any appropriate water measurement technique, preferably Aqua-Glo (ASTM Test Method D3240). The filter/coalescer cartridge is preferably a standard 14 inch long by 6 inch diameter filter/coalescer element housed in a single element test vessel. As previously indicated a system comprises a filter/coalescer cartridge and a separator cartridge in sequence. The complete system comprises at least one of such combinations. It is the filter/coalescer which is sensitive to the presence of additive in the fuels in combination with water. Thus, it is possible to determine the suitability of an additive for use in a fuel at various water content levels as well as the filterability of wet-additized fuel through a filter/coalescer and separator system as well as determining how to deliver fuels containing additives and different water content levels through a filter/coalescer and separator system by screening a fuel containing such additives, in combination with varying amounts of water and at various fuel flow rates, through just the filter/coalescer cartridge. It is preferable, however, to conduct the screening using a representative system comprising the filter/coalescer cartridge in combination with a separator cartridge, the separator cartridge being downstream of the filter/coalescer cartridge, to eliminate any variables possibly attributable to the separator materials. The separator comprises a 6" long by 6" diameter separator cartridge. Fuel flow rates recited herein in gallons per minute per inch (gpm/in) of cartridge are gallons per minute divided by the length of this standard 14 inch long and 6 inch diameter filter/coalescer cartridge for single cartridge tests. In the case when more than one cartridge is used in parallel, the gpm/inch is determined by dividing the gallons per minute by the length of the cartridge and dividing again by the number of cartridges. In the case of the present example, this is a single filter/coalescer cartridge. Note that generally aviation filter/coalescer cartridges are nominally 6 inch diameter. The flow is historically expressed in gpm/inch of 6 inch diameter cartridge for ease in comparing different filter/coalescer and separator systems and configurations.

Filter/coalescer cartridge conditioning can be at any flow rate, preferably about 1.4 to 2.1 gpm/inch of cartridge for any convenient period of time, preferably about 10 to 30 minutes. The size of the sample of fuel employed will vary depending upon whether the feed is recycled during each test run (recycling is preferred if the additive(s) present in the feed is (are) not removed by dirt/water contact in the filter) or on a once-through pass. Sample size depends on duration of each test run, feed flowrate, the number of test points to be recorded.

The above series of steps also can be performed after employing the API/IP 1581 $5^{th}$ edition element test protocol to deposit one-half dirt and full dirt in the filter/coalescer cartridge to simulate cartridge conditions at different periods of use during its effective lifetime so as to determine the feed fuel water content and feed fuel flow rate limits within which it will be necessary to operate over time as the element ages.

If fuels containing FSII additives are to be tested, the FSII additive (typically diethylene glycol monomethyl ether (DiEGME)) can be added to the fuel at any time (i.e., before or after the dirt testing in the previous paragraph). After ensuring that the effluent fuel water content of the fuel containing the FSII additive is below 15 ppm, the above series of steps is repeated at different feed fuel flow rates to establish the correlation between feed fuel water content and feed fuel flow rate to determine the operational limits of the cartridge coalescer/separator system within which the system must be run so as to dewater wet-additized jet fuels to achieve fuel having no more than 15 ppm water.

If the feed containing the FSII additive is being recirculated, it may be necessary to readditize with the FSII additive (typically DiEGME) during the test procedure, depending on the duration of the test, the volume of fuel and the water tolerance of the element. Different concentrations of such FSII additive(s) can be evaluated to determine the effect of increased/decreased FSII additive content in the fuel. In practicing the invention the discrete series of runs at different feed fuel flow rates through the filter/coalescer cartridge or filter/coalescer cartridge and separator cartridge system, in addition to determining the maximum water content of the feed fuel which can be successfully handled and the feed fuel flow rate at which this can be done, can also be further repeated to determine the effect, if any, that different temperatures may have on the filterability of the wet-additized fuel at the different feed fuel flow rates and/or also the effect different contaminants in the contaminating water may have on the filterability of the fuel; e.g., the effect of water pH, salt content, contamination with industrial chemicals and/or agricultural pesticides or herbicides, MTBE, etc. on the water tolerance of the filter/coalescer and separator system.

It has been discovered that fuels which are of enhanced thermal stability due to the addition of one or more thermal stability additive or additive package containing one or more thermal stability additives in combination with other additives and which have been identified as not being filter friendly in accordance with the current single-run pass/fail test system MSEP ASTM D3948 could still be successfully filtered if feed fuel flow rate is adjusted to accommodate and be responsive to the actual water content of the feed fuel being filtered and for the specific filter/coalescer and separator system which is actually employed in the specific ground-based system under consideration.

It has unexpectedly been found that by the evaluation of the real intended filter material using a sufficiently large fuel sample and filtering such fuel sample through the filter at a number of different fuel flow rates and water content levels, it is possible to identify a fuel flow rate at or below which it is possible to apply an API/IP 1581 filter system to filter wet-additized fuels to recover filtered fuels having a water content that is acceptable for fueling aircraft.

Heretofore it was not recognized that water coalescer and separator filter systems could be made to effectively dewater wet jet fuel regardless of the nature or type of additives present in such fuel, including the thermal stability additives, by controlling the feed fuel flow rate through actual filter elements relative to the water content of the wet fuel.

In the past fuels have been tested to determine whether or not they disarm the coalescers; that is to find whether they are filter friendly using a test identified as MSEP:ASTM D3948 Microseparometer which gives a single pass/fail point.

In MSEP:ASTM D3948 test, a fuel sample is doped with distilled water and agitated to form a fine emulsion which is then passed through a standard coalescer cartridge specified in the test method which is not the same composition of materials as will be used in the specific water coalescence process practiced in the actual fuel dewatering process for the delivery of dry fuel to the commercial or military end users. The cell (Alumicel®) used in the MSEP Test contains a bed of fiberglass coalescer material about 1/16" thick. Feed flow velocity is such that it takes for MSEP test unit Mode A (jet fuel mode) 45±2 sec for the 50 mL sample containing 0.1% water to pass through the test filter coalescer cell specified in the MSEP test protocol. The entrance and exit ports of the cell are about 1/16" diameter at the surface of the fiberglass.

The linear velocity of fuel/water through the Alumicel is about 2 orders of magnitude greater than that through an API/IP 1581 filter/coalescer cartridge.

If the fuel passed through the MSEP test cartridge is clear, it means for the purposes of the test the water has been successfully coalesced; if it remains cloudy the coalescer has not worked. The result is compared to the result obtained using the pre-emulsion fuel. The best rating is an MSEP rating of 100.

From this it can be seen that fuels failing the MSEP:ASTM D3948 test are rejected on the basis of a single point as not being suitable for API/IP 1581 filtering. Thus, in order to use an additive package which fails the MSEP test or might otherwise be incompatible with API/IP 1581 filtration in jet fuel it is necessary that the fuel be distributed without additives, so that the fuel is subjected to API/IP 1581 water removal prior to any additive addition then the additive is added to the fuel as it enters the plane. Plane-side additive addition is not preferred because of the large number of additive injection systems required, the cost of their ongoing maintenance and the increased complexity entailed in ensuring that the additive is always metered properly. This also means that fuel, once additized with such an additive which fails the MSEP test, cannot be returned to the fuel inventory storage facility. For example, the handling procedures fuel additized with one such enhanced thermal stability additive added to the fuel plane-side required either that all fuel removed from aircraft be diluted by a factor of 100 with unadditized fuel before the fuel could be returned to airport storage or that the fuel can be held in separate segregated storage facilities for processing or for disposal other than as aircraft jet fuel.

It has been found, however, that additized fuels wherein the additive can be of any type; e.g. additized with one or more thermal stability additives or additives packages containing one or more thermal stability additives and other additives; e.g., the additives of EP 1,533,359, can be transported as such, that is, in additized form, with their actual suitability for being subjected to API/IP 1581 water filtration being determined by testing the response of an actual sample of the API/IP 1581 filter/coalescer cartridge to be used in the commercial practice process to the additive, such testing being performed at a number of different feed fuel flow velocities, a number of different additive treat levels, measuring the water content of the filtered feed at each flow velocity and additive treat level, determining whether there is any flow velocity for any particular additized wet feed fuel and filter combination being evaluated which results in the production of dry fuel; i.e., filtered fuel with a water content of about 15 ppm, and employing such feed fuel filter rate in the practice of the dewatering step on such fuel feed fuel in the particular filter coalescer-separator system. Further, additive can be screened in the present system to determine their suitability for use as fuel additive for addition at any point in the fuel distribution system and not just plane-side at the point of delivery into the aircraft fuel tank. By determining, using an actual sample of the filter/coalescer cartridge intended for actual use in the practice of the jet fuel dewatering process, which additive(s) is/are filter friendly, the practitioner is free to add the additive at any point in the delivery process including into the pipeline at the refinery or, into the fuel inventory storage tanks at the refinery, at the airport or elsewhere. Such fuel already in an aircraft fuel tank can be removed (i.e., the aircraft can be defueled) and the recovered fuel returned to fuel inventory without special handling or the need to be segregated.

The present procedure is to be distinguished from the standard test method for determining water separation characteristics of aviation turbine fuels using a portable separameter, MSEP:ASTM D3948 which employs 50 ml samples of fuel wetted with 50 μl of distilled water which is pushed mechanically out of a syringe through an Alumicel (fiberglass) coalescer such test obviously employing only a single feed flow rate using only about 50 ml total sample at only a single water content level at a linear velocity about 2 orders of magnitude higher than experienced by filters in the distribution system using a coalescers unlike those used in API/IP 1581 systems.

In contrast, the present method utilizes as the test filter at least one standard filter/coalescer cartridge representative of the actual filter cartridge employed in the coalescer/coalescer and separator system, a large volume of feed which either itself is or is representative of the actual, additized feed which is intended to be processed in the filter/coalescer and separator system in a series of runs at different feed fuel flow rates, the additized fuel either being the actual wet fuel to be filtered for commercial delivery or the additized fuel having water added at a metered rate to identify the capacity of the filter to handle wet-additized fuel at different water content levels and different feed flow rates to deliver effluent feed with a water content of 15 ppm, a number of different flow rates being evaluated with the water content of the filtered fuel and the water content of the feed fuel being measured at each flow rate.

Thus, the present invention:

Discloses an improved method for delivering fit-for-purpose enhanced thermal stability fuel to aircraft using the existing distribution system Provides a method for determining the compatibility (with respect to water removal) of an additized fuel with the existing distribution system Provides a method to assess the modifications that must be made to the existing distribution system to remove water from an additized fuel that is not "filter friendly"

EXPERIMENTAL

Samples of jet fuel each containing different thermal stability enhancing additives were evaluated. The filter system in each test run comprised an API/IP 1581 5th edition Category M100 filter/coalescer cartridge having a nominal length of 14 inches and diameter of 6 inches and an API/IP 1581 $5^{th}$ edition single element test separator cartridge of 6 inches nominal diameter and length (in sequence). The filter/coalescer cartridge is comprised of a combination of dirt filtering (e.g. filter paper or microglass) pleated materials and water coalescing (e.g. resin treated fiberglass) layers. The separator cartridge is comprised of a single sheet of Teflon-coated screen. Enough on-specification Jet A or Jet A-1 fuel is sampled and additized with test additive(s) to conduct the test. The amount of test fuel required will vary depending upon whether the fuel is recycled during testing (preferred if the additives are not removed by dirt/water contact) or used single pass. Other variables include the number of test points and the flowrates at each test point. In the testing described herein about 3500 gallons of jet fuel was employed in "recycle mode." Each test consisted of employing the filter/coalescer cartridge in either clean condition (i.e., representative of a fresh filter), ½ dirt condition (representative of a filter which has been in use for some time, dirt being a combination of red iron oxide and silicate specified in API/IP 1581 $5^{th}$ edition to mimic real-world contaminants which are present in fuel), or full dirt condition, to represent a filter near the end of its service life cycle. A fuel also containing FSII additive at a 0.15 wt % rate was tested, the FSII additive being DiEGME, in addition to either of the two thermal stability additives. The sequence of tests for each additive were run using a single filter/coalescer cartridge per additive. To be explicit, the water and fuel flowrates resulting in 15 ppm effluent free water were mapped first with the clean cartridge then with the same cartridge after loading with ½ dirt then again after loading with full dirt and finally with full dirt after adding DiEGME to the fuel.

The fuel containing the additive was wetted by metering water into the feed. It was found that a fuel water content of about 0.010% (100 ppm) water for the fuel containing the thermal stability enhancing agent identified as SPECAID8Q462 (256 mg/L), which contains an active detergent/dispersant manufactured by Betz Dearborn (now G. E. Water & Process Technologies) and identified on FIGS. 1 and 2 as "BETZ" could still be successfully filtered to a water content of about 15 ppm water within a broad range of feed fuel flow rates depending on filter condition, about 3.7 gpm/inch cartridge maximum for a clean filter, despite being classified as unfilterable in the industry as having failed the MSEP ASTM D3948 microseparometer qualification test. The incompatibility of this additive with the API/IP 1581 filtration in the existing commercial distribution system is, however, confirmed because most AP/IP 1581 filtration is sized to remove 3% water at flowrates greater than 2.6 gpm/in.

In like manner it was found using the procedure of metering water into the additized fuel at different feed fuel flow rates, that feed additized (256 mg/L) with the additive presented in EP 1,533,359, and identified on FIG. 1 as "EP '359", can be successfully filtered when the water content was less than 4 wt % at a feed fuel filter rate of about 2.6 gpm/inch cartridge maximum for a clean filter.

Above these individual water content values and/or feed fuel flow rate, the fuels could not be filtered to an effluent water content level of 15 ppm maximum.

In all cases, the object was to produce a fuel filtrate containing 15 ppm water.

The results of the experiments are presented in FIG. 1.

In FIG. 1 it is seen that for fuel containing the EP 1,533,359 additive the results for the new cartridge and the same cartridge described above with ½ dirt loading the system could separate 1% water at 67 gpm (4.8 gpm/in (fresh)), 4.5% water at 36 gpm (2.6 gpm/inch (fresh)) and 5.5% water at 30 gpm (2.1 gpm/in (½ dirt)). Interpolating a line that fits these results indicates that 3% water can be separated at up to about 50 gpm (3.6 gpm/in). When the cartridge is loaded with the full dirt the water handling capacity is reduced at full dirt (see solid triangles). Extrapolating this line indicates that the system could separate about 3% water at 38 gpm (2.7 gpm/in). This is very near the design limit for most existing API/IP 1581 filtration in the distribution system which means that an enhanced thermal stability jet fuel using the additive in EP 1,533,359 can be formulated at the refinery and distributed via the current distribution system either without any changes to the distribution system or in some cases, with a small amount of throttling of flowrates.

Conversely, the fuel containing the SPECAID8Q462 (BETZ) which is classified in the art as failing the ASTM-3948 test and thus not a candidate for filtering at all was unexpectedly found to be successfully filtered at water concentrations of up to about 100 ppm at fuel flow rate of up to about 37 gpm (or up to about 2.6 gpm/inch of filter cartridge). The results confirm that while this additive can be filtered provided the water content or the fuel flow rate is low enough, it is not a candidate for addition at refineries with the existing distribution system because currently the fuel water content is not determined at the point of delivery and the flowrate required to remove higher water concentration; e.g., up to about 3% water (the design specification of the current system) would be so low that API/IP 1582 fuel filtration rates would be impractical. However, when new water monitoring technology such as that anticipated by API/IP 1598 is fitted to the distribution system this filtration technology can be employed. Currently the water content is not usually known or determined upstream of the API/IP 1581 filtration system in the existing distribution system. Because the aviation fuel distribution system is generally specified to use API/IP 1581 filtration and API/IP 1581 is tested and certified with 3% water, this means the system is generally designed to handle up to 3% water. This level of water is relatively high and usually not exceeded in the distribution system. The filter vessels and flowrates are sized accordingly and generally are not varied. A lower level of water handling capability might be used to recover a specific batch of fuel (off-line) under a special condition but currently would not be used directly in the distribution system in fuelling planes because of the increased liability that may result if operations are not conducted according to accepted industry practice. The implementation of API/IP 1598 condition monitoring is anticipated to change the paradigm because it will directly measure water in fuel, which may enable some flexibility in fuel filtration practices.

It can be seen that wet fuels containing additive which additive heretofore were considered to be filter unfriendly according to the MSEP:ASTM D-3948 one point pass/fail test procedure and thus rendered wet fuels containing such additive to be deemed unsuitable for filtration to remove water therefrom can nonetheless be successfully filtered using actually employed filter/coalescer and separator cartridge elements to produce fuel filtered to contain 15 ppm or less when either or both the water content of the fuel feed is sufficiently low and within the cartridge's ability to tolerate or the feed fuel flow rate can be varied is controlled to be within the cartridge's degree of tolerance for the water content encountered.

Thus, by evaluating each real feed on a sample of filter/coalescer cartridge per se or preferably on a sample of the filter/coalescer cartridge and separator cartridge system actually intended to be employed in the specific commercial/military coalescer-separation system and varying the feed fuel flow rate, a map similar to FIG. 1 can be generated showing a regime of water content to fuel feed flow rate within which the specific wet-additized fuel can be filtered to yield a fuel filtrate containing 15 ppm or less water suitable for delivery to the end user. The values plotted on FIG. 1 were determined using plots exemplified by FIG. 2 for a specific point.

Figure 2:
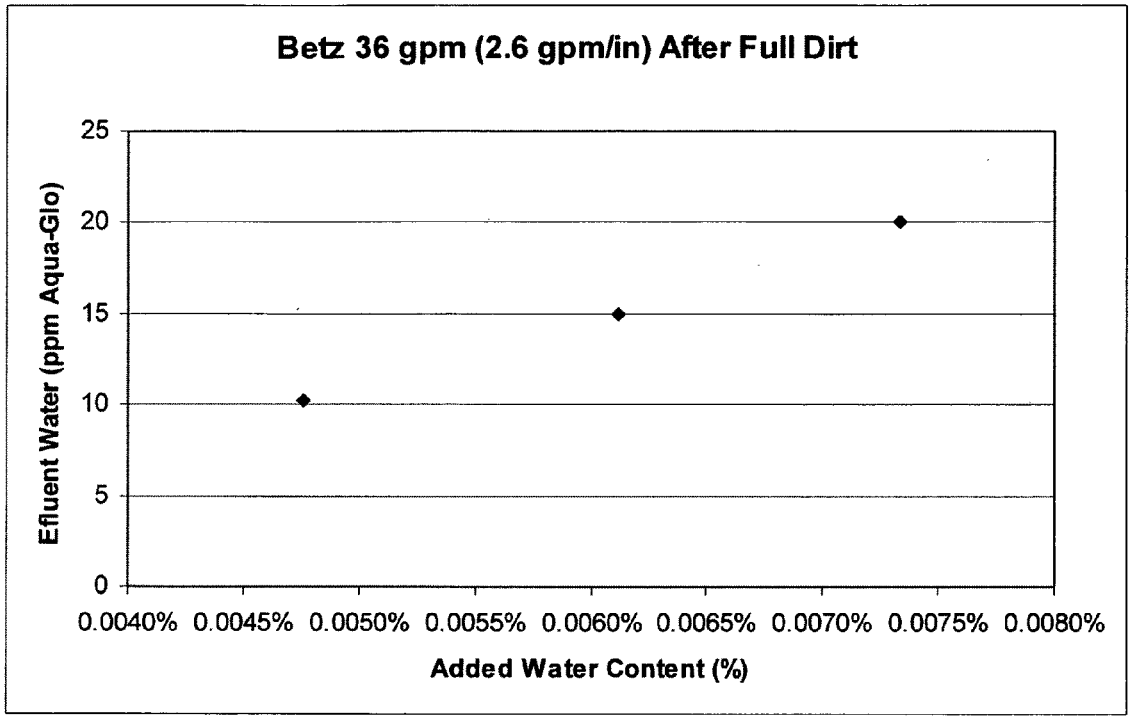
FIG. 2 presents the graphical representation of the data resulting from the evaluation of SPECAID8Q462 (BETZ) at 2.6 gpm/inch on a filter element holding the full amount of dirt as the water content was varied. This data represents one point on the Map of FIG. 1 (Open Circle).

FIG. 2 shows the data plot for the test run conducted using the test cartridge at full dirt on the SPECAID8Q462 (BETZ) additive at one flow rate. The fuel flow rate is set, then the amount of water added is varied until the value of 15 ppm effluent water (measured by AquaGlo) is either actually obtained or determined by interpolation or by a limited extrapolation. In the case of FIG. 2 the point at 15 ppm corresponds to an actual test point showing that at the set fuel flow rate of 36 gpm (2.6 gpm/in) a dirt filled cartridge could produce an effluent containing 15 ppm water provided the water content of the wet fuel was 0.0061%, and this point is plotted on FIG. 1 as the open circle at 0.0061% water concentration at 36 gpm flow rate. If this point had not been actually hit in the course of the test then the result for 15 ppm water would have been determined by interpolation between the point at 10 ppm and 20 ppm water in effluent. When values are within 2 ppm of the 15 ppm target fuel feed water content can be determined by extrapolation. As shown in FIG. 1, higher water content could be tolerated by the filter at lower fuel flow rates to give effluent fuel with a 15 ppm water content.

What is claimed is:

1. A method for identifying additives for addition at any point in a jet fuel distribution system for the delivery of additized jet fuel with an acceptable water content, through a commercial dewatered jet fuel delivery process, such method comprising:

(1) securing a sample of dry-unadditized jet fuel;

(2) incorporating one or more of the additives being evaluated into the jet fuel sample;

(3) securing an operable filter/coalescer cartridge of the type to be used in the practice of the commercial dewatered jet fuel delivery process;

(4) circulating dry-additized jet fuel through the filter/coalescer to condition the filter/coalescer cartridge;

(5) passing the dry-additized jet fuel through the conditioned cartridge at an initial controlled fuel flow rate to produce a fuel effluent;

(6) measuring the water content of the fuel effluent;

(7) metering water into the additized fuel at different rates to establish different water content levels in the additized fuel while flowing the fuel through the cartridge and monitoring the water content of the fuel effluent at the different additized fuel water content levels;

(8) repeating steps 4 through 7 at a number of different fuel flow rates;

(9) recording the additized fuel water content levels and fuel effluent water content levels at each of the different fuel flow rates;

(10) determining whether the additized fuel at any water content level at the different flow rates gives an effluent fuel meeting the acceptable water content level;

(11) making a plot of the wet-additized fuel flow rate versus the additized fuel water content level values for those additized fuels that yield an effluent fuel meeting the acceptable water content level;

(12) determining from the plot the additized fuel water content levels and fuel flow rates that produce dewatered additized jet fuel;

(13) determining the acceptability for addition at any point in the jet fuel delivery system the additive or additives whose presence in the jet fuel will not prevent the filter/coalescer cartridge from dewatering the wet-additized fuel to an acceptable water content level at an acceptable fuel flow rate.

2. The method of claim 1 wherein the acceptable water content in the fuel effluent is 15 ppm maximum (US(ATA-103) standard).

3. The method of claim 1 wherein the acceptable water content in the fuel effluent is 30 ppm maximum (IATA(International) standard).

4. The method of claim 1 wherein the filter/coalescer cartridge is a new, previously unused cartridge.

5. The method of claim 1 wherein the filter coalescer/separator cartridge is 14 inches long and 6 inches in diameter.

6. The method of claim 5 wherein the initial controlled fuel flow rate is about 2.6 gallons per minute per inch in length of cartridge.

7. The method of claim 1 wherein the filter/coalescer cartridge is used in combination with a separator cartridge forming a system.

8. The method of claim 5 wherein the separator cartridge is 6 inches long and 6 inches in diameter.

9. The method of claim 1 wherein the additive added to the fuel is at least one thermal stability additive.

10. The method of claim 7 wherein the thermal stability additive comprises one or more copolymer, terpolymer or polymer of an ester of acrylic acid or methacrylic acid or a derivative thereof wherein the copolymer, terpolymer or polymer of an ester acrylic acid or methacrylic acid or derivative thereof is copolymerized with a nitrogen-containing or amide-containing monomer, or the copolymer, terpolymer or polymer of an ester of acrylic acid or methacrylic acid or derivative thereof includes nitrogen-containing, amine-containing or amide-containing branches.

11. The method of claim 9 wherein the fuel further contains a Fuel System Icing Inhibitor (FSII) additive.

12. The method of claim 11 wherein the FSII additive is DiEGME.

13. The method of claim 1 in which the dry-additized jet fuel is circulated through the filter/coalescer in step (4) for a period of 10 to 30 minutes to condition the filter/coalescer cartridge.

14. The method of claim 1 in which the fuel flow rate at which an effluent fuel water content meeting the acceptable water content level is determined in step (10) is used for the practice of the dewatering step on such feed fuel in the particular filter/coalescer system.

* * * * *